US005621846A

United States Patent [19]

Smith et al.

[11] Patent Number: 5,621,846

[45] Date of Patent: Apr. 15, 1997

[54] RADIANT ELECTRIC SPACE HEATER WITH ANGULAR ADJUSTMENT SUPPORT BRACKET

[75] Inventors: Barry W. Smith, Scioto Township, Delaware County; Michael T. Kopczewski, Orient, both of Ohio

[73] Assignee: The W. B. Marvin Manufacturing Company, Urbana, Ohio

[21] Appl. No.: 443,219

[22] Filed: May 17, 1995

[51] Int. Cl.[6] ..... F24C 1/14; F24H 3/00

[52] U.S. Cl. ..... 392/376; 392/370; 392/364; 416/246; 248/324; 248/327

[58] Field of Search ..... 392/376, 375, 392/370, 373, 374, 363–367, 381–382; 416/246; 248/317, 324, 343, 333, 327; D23/337

[56] References Cited

U.S. PATENT DOCUMENTS

| | | | |
|---|---|---|---|
| D. 152,397 | 1/1949 | Damond | D23/337 |
| D. 323,553 | 1/1992 | Claypool | D23/337 |
| D. 361,832 | 8/1995 | Cunning | D23/337 |
| 2,495,513 | 1/1950 | Doyle . | |
| 3,059,090 | 10/1962 | Waters | 392/376 |
| 3,087,118 | 4/1963 | Goffstein | 248/317 |
| 3,322,946 | 5/1967 | Cooper . | |
| 3,425,655 | 2/1969 | Cogdill . | |
| 4,191,879 | 3/1980 | Kerchner, Jr. . | |
| 4,410,933 | 10/1983 | Blake et al. | 248/324 |
| 4,760,243 | 7/1988 | Tedioli | 392/370 |
| 5,381,509 | 1/1995 | Mills . | |

FOREIGN PATENT DOCUMENTS

| | | |
|---|---|---|
| 201740 | 1/1959 | Austria . |
| 75675 | 6/1953 | Norway . |
| 421405 | 3/1967 | Switzerland . |

OTHER PUBLICATIONS

Advertisement for Quartz Modular Heaters, published by Tansun–Quartzheat Division, Tunnel Road, Hill Top, West Bromwich, West Midlands B70 ORD, published at least as early as Sep. 10, 1993.

*Primary Examiner*—John A. Jeffery
*Attorney, Agent, or Firm*—Roger S. Dybvig; John J. Cheek

[57] ABSTRACT

A radiant electric heater has a pair of bracket arms rotatably attached to opposite ends of a housing secured to a support bracket attached to a ceiling over a work space. A control switch mounted on one of the bracket arms and a control knob secured to the switch are substantially centered on the housing's axis of rotation. The housing is rotatable relative to the bracket arms throughout an angle of not more than 90 degrees and can be held in any one of several angular positions. The control knob may have a ball chain attached thereto to control operation of the heater from a position remote from the heater. In a modification, heat shields are provided along the upper and lower margins of a reflector assembly to prevent extreme heat build-up on the heater housing.

27 Claims, 5 Drawing Sheets

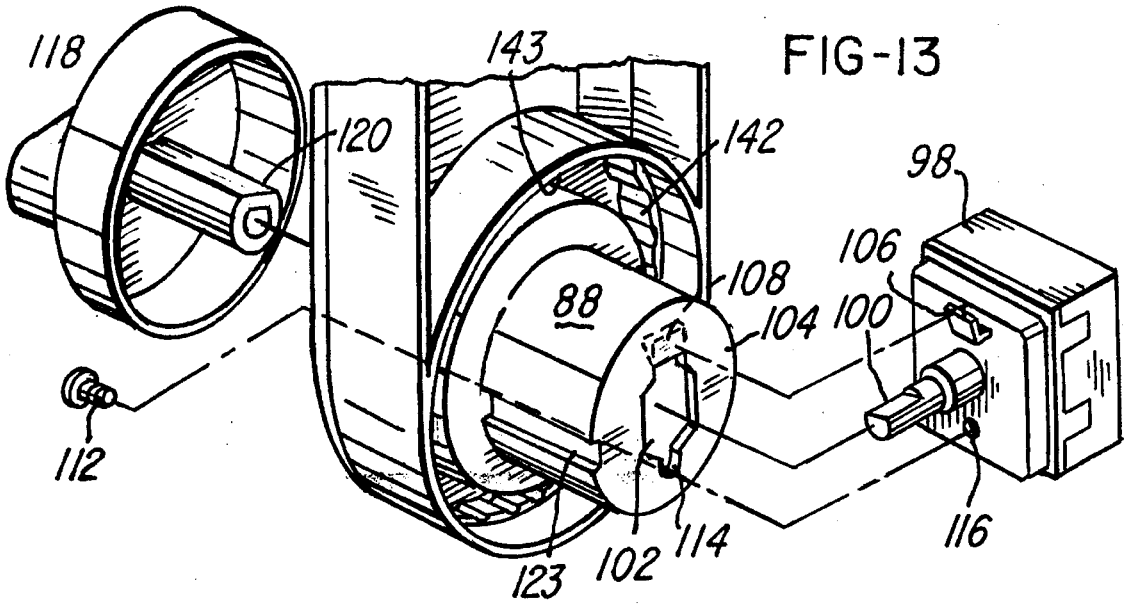
FIG-13
FIG-14
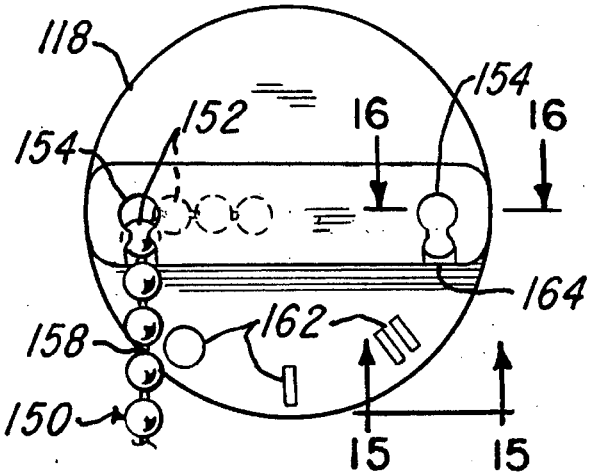
FIG-15
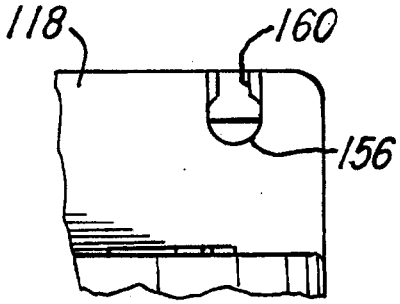
FIG-16
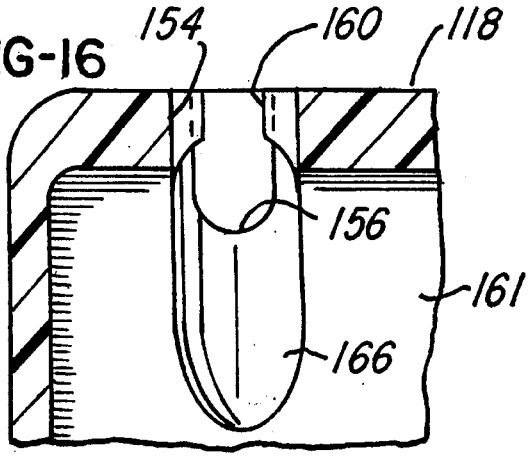

RADIANT ELECTRIC SPACE HEATER WITH ANGULAR ADJUSTMENT SUPPORT BRACKET

FIELD OF THE INVENTION

This invention relates to electric space heaters and, more particularly, to radiant electric workshop heaters.

BACKGROUND OF THE INVENTION

Heaters are often used in a work space to provide heat to selected parts of the work space. Prior heaters adequately serve this function, but often direct heat to a limited area. For example, prior heaters often provide heat only to the leg, hand or head area of a person in the work space. Prior heaters also require a flat support surface on which the heater can be placed. Thus, prior heaters can only be used in a work space provided with flat surfaces such as countertops and workbenches. Of course, prior heaters could be placed on the floor of the work space, but such placement limits the effective heating area of the heater to the space around the leg area of a person in the work space.

Prior workshop heaters are primarily hot air heaters that were incapable of directing heat across relatively large distances. Because prior heaters are placed on the floors, countertops or workbenches, the potential for fires started by the heaters is significant if the heaters are not provided with effective safety features such as tip-over switches and high heat-limiting circuits. A further hazard exists with prior heaters because their placement makes them susceptible to being covered or draped by flammable material such as a curtain or rags. To avoid fire hazards, prior heaters include grills covering the front of the heaters to prevent objects from directly contacting the heating elements. Fixes grills are often provided to prevent accidental or casual removal of the grills.

SUMMARY OF THE INVENTION

An object of this invention is to provide a ceiling mounted electric heater that is rotatable to direct heat to a selected area of a work space. Another object is to provide an improved radiant electric workshop heater. A further object is to provide such a heater having a control switch that has a fixed orientation relative to the work space.

Another object of this invention is to provide a workshop heater having a housing which can be pivoted through a limited angle.

A further object of this invention is to provide a heater with easily separable parts to enable the heater housing to be readily detached from a ceiling-mounted bracket.

An additional object of this invention is to provide a radiant electric space heater that meets recognized safety standards, yet has a simple construction not requiring complex safety devices.

In accordance with this invention, a radiant electric heater has a housing, a reflector assembly mounted in the housing, and heating elements within the reflector assembly extending between opposite ends thereof. A pair of bracket arms are rotatably attached to opposite ends of the housing and are adapted to be detachably mounted on a ceiling-mounted support bracket. A control switch mounted on one of the bracket arms and a control knob attached to the switch are substantially centered on the heater's axis of rotation. To limit rotation, the heater may also include plastic end caps to which the bracket arms are connected. Retaining rings that secure the bracket arms to the end caps have stop tabs that engage raised stop surfaces on the end caps to limit rotation of the housing. Cooperating frictional coupling members on the bracket arms and the housing hold the housing in any one of a plurality of angular positions.

Further in accordance with this invention, a inverted generally U-shaped support bracket cooperates with the bracket arms to mount the heater to the ceiling so that the heater housing is detachably connected to the support assembly. The support bracket has a pair of spaced-apart support arms to which the bracket arms are detachably connected.

Yet another object of this invention to provide a ceiling mounted heater that may be operated from a position remote from the heater, e.g. by a person standing on the floor beneath the heater. To this end, the heater may also include a draw string or ball chain attached to the control knob that allows the control knob to be operated from a position remote from the heater. The control knob and ball chain may also be such that extreme force on the ball chain in a direction away from the control knob will cause the ball chain to come loose or break away from the control knob without damaging the control knob or ball chain.

Another object of this invention is to provide a heater having insulated portions that are cool to the touch that can be gripped for rotating the heater. This is accomplished by constructing the heater housing to include an outer wrapper and a pair of plastic end caps attached to opposite ends of the outer wrapper. A pair of baffle walls located at opposite ends of the outer wrapper adjacent respective ones of the end caps insulate the end caps from non-reflected heat energy from the heating element and the reflector assembly so that the end caps remain cool to the touch. The heater may also include slotted heat exhaust plates on opposite sides of the reflector assembly that permit heat energy built up between the reflector assembly and the outer wrapper to escape through slots in the plates.

In modification, another object of this invention is to provide a heater having heat shields for directing rising heat away from the housing of the heater.

Other objects and advantages will become apparent from the following description and the drawings.

BRIEF DESCRIPTION OF THE DRAWINGS

FIG. 13 is an enlarged, fragmentary, exploded perspective view of the left side bracket arm, a switch that is mounted on the bracket arm, and control knob attached to the switch.

FIG. 14 is an elevational view of the switch control knob shown in FIG. 13 and a fragment of a ball chain attached thereto.

FIG. 15 is a fragmentary elevational view, on larger scale than FIG. 14, looking in the directions of arrows 15—15 of FIG. 14 showing an aperture formed in the control knob.

FIG. 16 is a fragmentary cross-sectional view taken along line 16—16 of FIG. 14 showing an aperture formed in the switch control knob and an interior relief inside the control knob.

DETAILED DESCRIPTION

Figure 1:
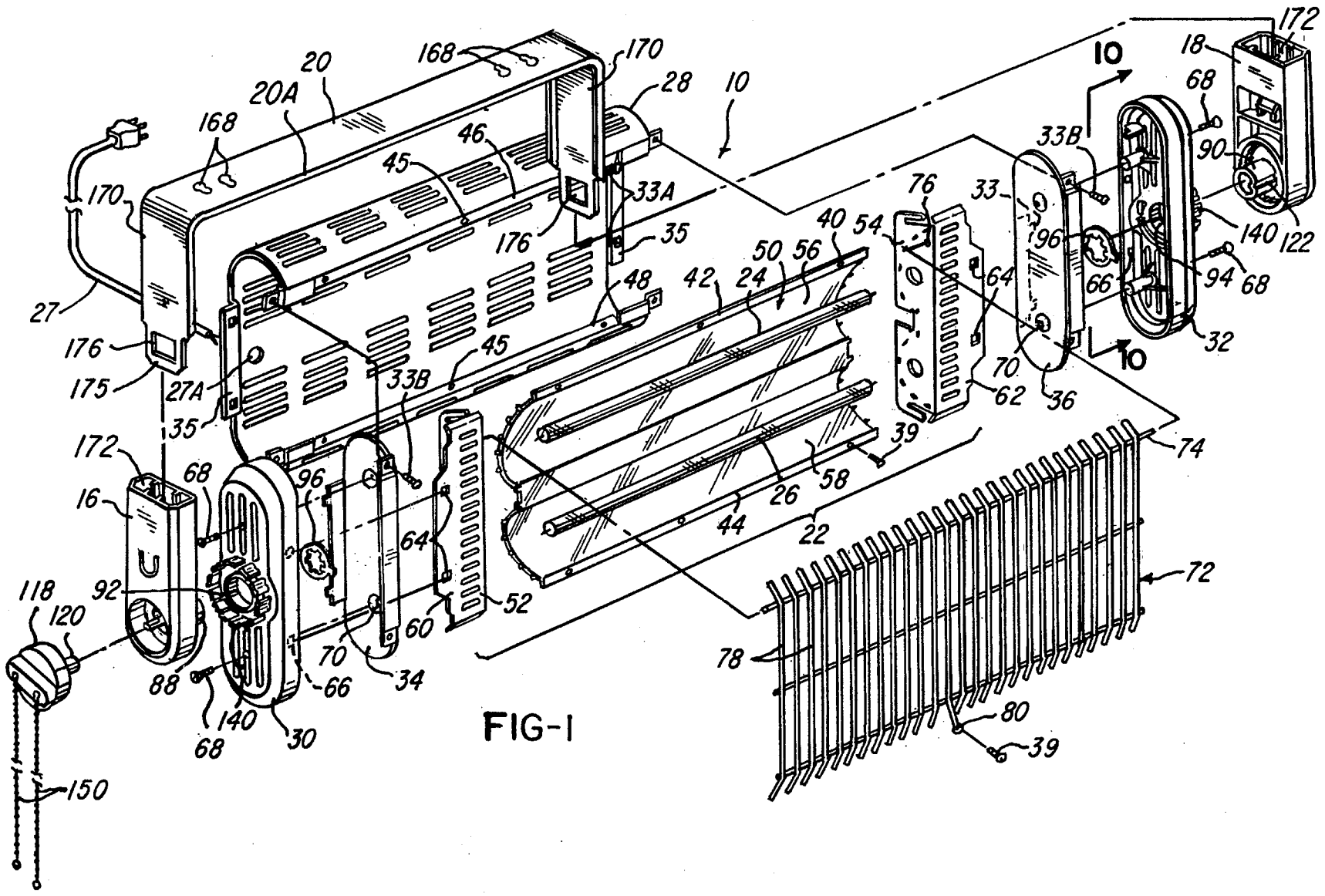
FIG. 1 is an exploded perspective view of a radiant electric workshop heater in accordance with this invention.
Figure 2:
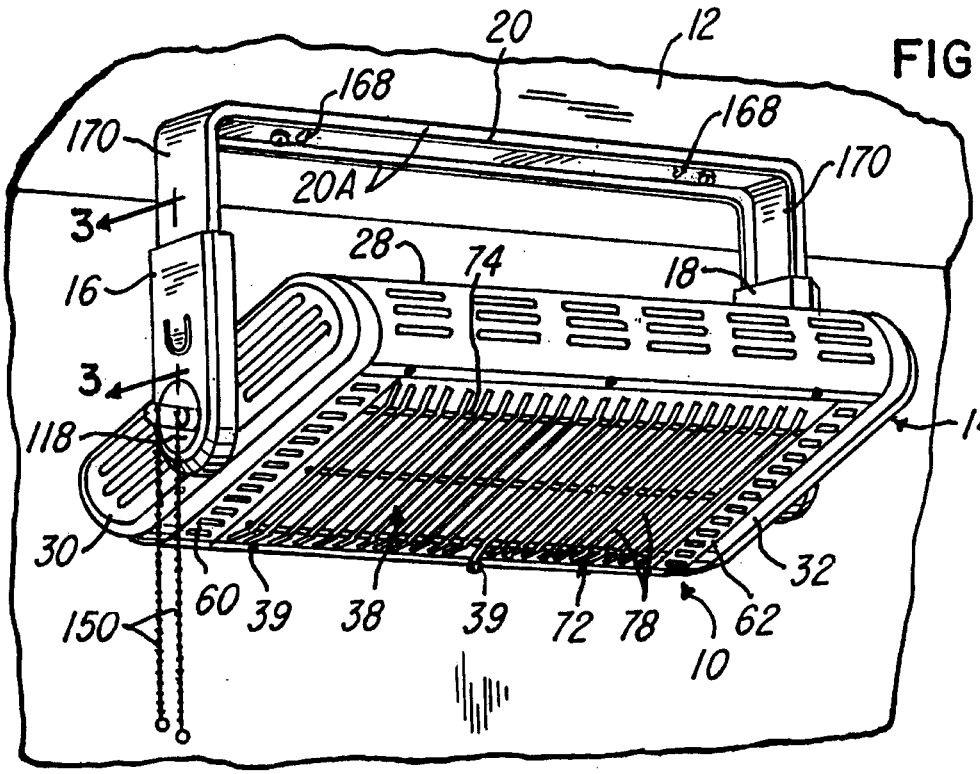
FIG. 2 is a perspective view of the heater of FIG. 1 shown mounted to a ceiling, a fragment of which is also illustrated in FIG. 2.

A radiant electric space heater in accordance with this invention, generally designated 10, is shown mounted to a ceiling 12 in FIG. 2. Heater 10 comprises a housing, generally designated 14, rotatably mounted on a left side bracket arm 16 and a right side bracket arm 18. Bracket arms 16 and 18 are detachably secured to a sheet metal support bracket 20 that is mounted on the ceiling 12. With reference to FIG. 1, the heater 10 also includes a reflector assembly, generally designated 22, and upper and lower heating elements 24 and 26, respectively, located in the reflector assembly 22 and extending between opposite ends thereof. A power cord 27 provides electrical power to the heating elements 24 and 26 and enters the housing 14 through opening 27A.

With reference to FIG. 1, the housing 14 includes a metal outer wrapper 28 and a pair of end caps 30 and 32 that are attached, respectively, to opposite ends of the outer wrapper 28 and are preferably formed from a plastic material. ABS plastic is presently preferred, but other plastics, such as polypropylene, may be used. A pair of baffle walls 34 and 36 are connected, respectively, to opposite ends of the outer wrapper 28 by a pair of tabs 33 on each baffle wall 34 and 36 that are received within notches 33A in end flanges 35 at each end of the wrapper 28. A pair of screws 33B, only one of which is shown in FIG. 1, fixedly connects each of the baffle walls 34 and 36 to the front corners of the outer wrapper 28.

With reference to FIG. 2, outer wrapper 28 and end caps 30 and 32 define a rectangular heat-transmitting window 38 in the housing 14. Referring to FIG. 1, reflector assembly 22 is mounted in the housing 14 in the window 38 so that the forward plane of the reflector assembly 22 is substantially coplanar with the window 38. It is presently preferred to attach the reflector assembly 22 to the outer wrapper 28 of the housing 14 by screws 39, only two of which are shown, that extend through apertures 40 in upper and lower margins 42 and 44, respectively, of the reflector assembly 22 and into apertures 45 in the upper and lower margins 46 and 48, respectively, of the outer wrapper 28.

Reflector assembly 22 includes a reflector panel 50 and spaced sidewalls 52 and 54. The reflector panel 50 has a heat reflective surface facing the heat-transmitting window 38 and the sidewalls 52 and 54 have heat reflective surfaces facing one another. The illustrated reflector panel 50 has elongate parabolic sections 56 and 58 provided to focus the radiant heat reflected thereby to a relatively restricted area. Preferably, reflector sidewalls 52 and 54 have integral slotted heat exhaust plates, designated 60 and 62, respectively, that extend perpendicularly thereto.

The radiant heating elements 24 and 26 are so mounted in the reflector assembly 22 that the parabolic sections 56 and 58 of the reflector panel 50 are behind the heating elements 24 and 26, respectively, which are of the type known as "quartz" heating elements and are shown in simplified form in the drawings. As known in the art, these each comprise a length of coiled resistance wire (not shown) positioned in a high quality glass or so-called "quartz" tube. However, it should be noted that the invention described below may be used with heaters having other types of heating elements, e.g. simple wrapped or else coiled resistance wire heating elements, and having different forms of reflector panels, including essentially planar reflector panels. Here it may be observed that the reflector assembly 22 and the heating elements 24 and 26 may be the same as the corresponding elements shown in U.S. Pat. No. 5,381,509 issued to Thomas H. Mills on Jan. 10, 1995.

For construction purposes, the heat exhaust plates 60 and 62 and the ends of the outer wrapper 28 may have notches 64 provided therein that receive tabs or hooks 66 formed on the inside of the end caps 30 and 32 to temporarily hold the end caps 30 and 32 to the outer wrapper 28 and the reflector assembly 22. A pair of screws 68 extend through each end cap 30 and 32 and into apertures 70 in the baffle walls 34 and 36, respectively, to permanently attach the end caps 30 and 32 to the outer wrapper 28 and the reflector assembly 22. As the end caps 30 and 32 are ultimately held in place by screws 68, the notches 64 and the hooks 66 are entirely optional and are provided for convenience during construction.

With reference to FIGS. 1 and 2, a protective grill 72 may be provided covering the window 38 to prevent unintended access to the reflector assembly 22 and the heating elements 24 and 26. Preferably, the grill 72 includes a horizontal cross wire 74 which has ends extending through aligned apertures 76 in the reflector sidewalls 52 and 54. Also, the grill 72 may include plural vertical grill wires 78 including one located near the center of the window 38 that has a screw eye 80 formed at one end through which the central one of the screw 39 extends. With this construction, the central screw 39 may be unscrewed to enable one to lift the grill and pivot it about the axis of the cross wire 74, thereby providing access to the reflector assembly for purposes of cleaning the reflector assembly 22. This type of grill and grill mounting in also shown in the aforementioned Mills '509 patent.

Figure 10:
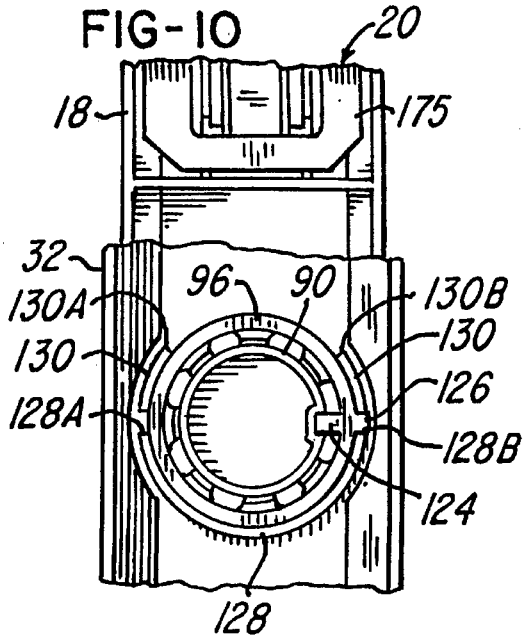
FIG. 10 is an enlarged, fragmentary elevational view of a plastic end cap, the right side bracket arm, and a retaining ring, taken as indicated by arrows 10—10 of FIG. 1, showing the connection of the end cap to the bracket arm and structure for limiting rotation of the housing relative to the bracket arms.
Figure 11:
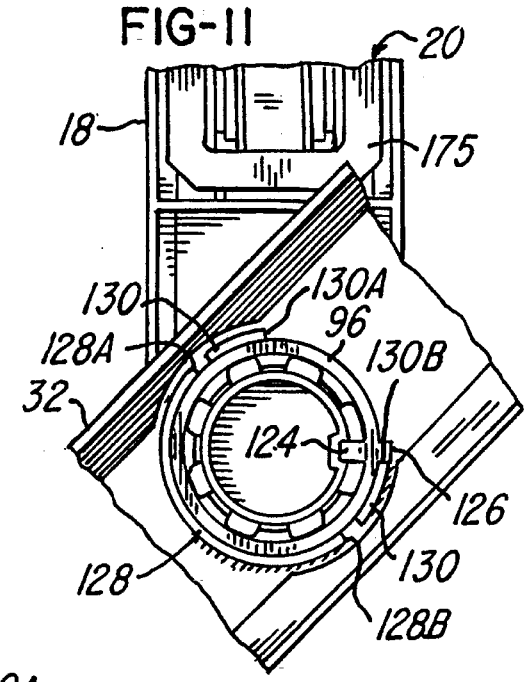
FIG. 11 is fragmentary elevational view similar to FIG. 10 but showing the end cap in the first 45 degree position of FIG. 8.
Figure 12:
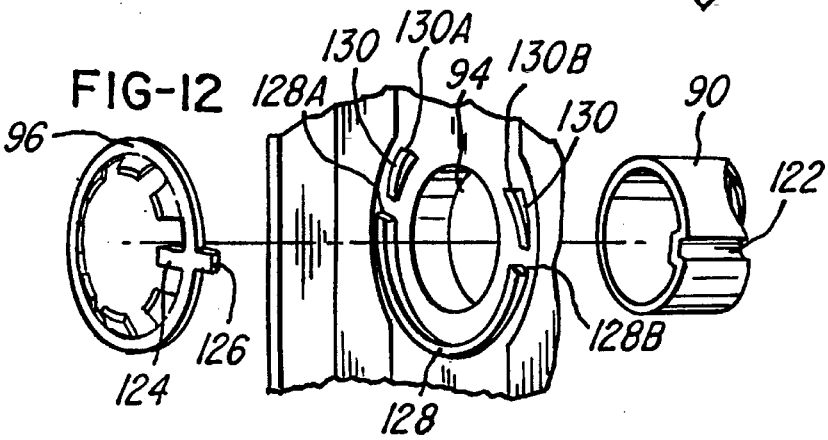
FIG. 12 is a fragmentary, exploded perspective view of a portion of the right side end cap, a hub portion of the right side bracket arm, and the retaining ring shown assembled in FIGS. 10 and 11.

Referring to FIGS. 10 through 12, the right side bracket arm 18 is rotatably connected to the right side end cap 32. The left side bracket arm 16 is similarly connected to the left side end cap 30 so that the housing 14 can rotate relative to the bracket arms 16 and 18 about an axis that extends from one side to the other through the center of the housing 14. With reference also to FIG. 1, the bracket arms 16 and 18 have cylindrical hub portions 88 and 90, respectively, that are received in circular openings 92 and 94 in the end caps 30 and 32, respectively. A spring steel retaining ring 96 is pushed onto and frictionally engages each of the hub portions 88 and 90 to secure the bracket arms 16 and 18 to the end caps 30 and 32.

With reference to FIG. 13, a commercially-available, three position rotary switch, generally designated 98, is used to control the operation of the heater 10. The switch 98 is so attached to the hub portion 88 of the bracket arm 16 that the control shaft 100 of the switch 98 lies substantially along the axis of rotation of the housing 14. By mounting the switch 98 in this manner, the switch 98 maintains a consistent orientation relative to the bracket arms and to the surrounding work space, regardless of the orientation of the housing 14 relative to the bracket arms 16 and 18.

As evident from FIG. 13, the control shaft 100 extends through a key-shaped opening 102 in a wall 104 located at the inner end of the left side hub portion 88. To hold the switch 98 in place, a tab 106 on the switch 98 is located within a pocket 108 in the outwardly-facing surface of the hub inner wall 104. Additionally, a screw 112 extends through a semi-circular notch 114 extending from the opening 102 and into a tapped bore 116 in the switch 98. A cylindrical control knob 118 is non-rotatably mounted on the switch control shaft 100 and is also substantially centered on the axis of rotation of the heater 10. As is common, the control shaft 100 is provided with a flat that matches the inner contour of the shaft 120 of the control knob 118 so that rotary movement of the control knob 118 is imparted to the switch control shaft 100.

Figure 7:
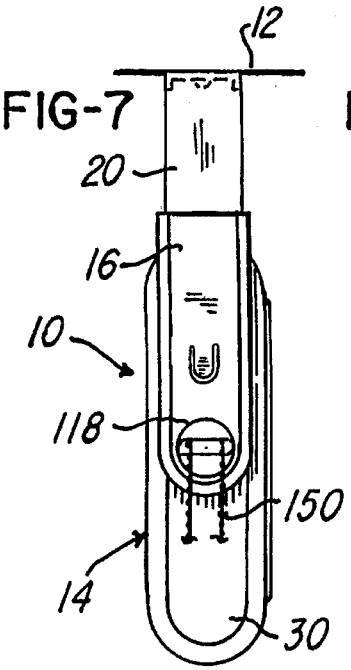
FIG. 7 is a side elevational view, on a scale smaller than FIGS. 3 through 6, of the heater shown mounted to the ceiling.
Figure 8:
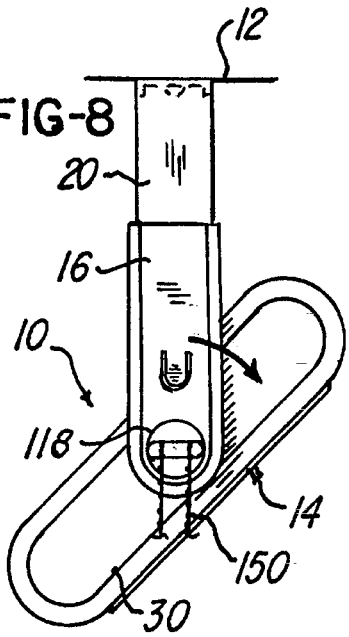
FIG. 8 is a side elevational view similar to FIG. 7 but showing the housing rotated to a first 45 degree position relative to the bracket arms.
Figure 9:
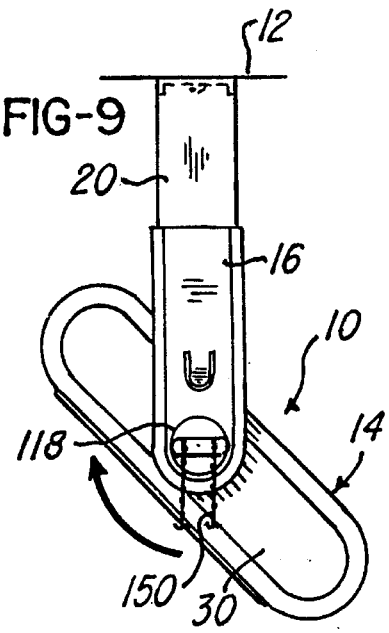
FIG. 9 is side elevational view similar to FIGS. 7 and 8 but showing the housing further rotated through 90 degrees to a second 45 degree position relative to the bracket arms.

With reference to FIG. 7, the heater housing 14 and the bracket arms 16 and 18 are preferably packaged for storage and shipment in a configuration such that the housing 14 is aligned with the bracket arms 16 and 18. Such configuration, however, is not an intended operating configuration for the heater 10 because the heater 10 is intended, in the embodiment shown, to be mounted on the ceiling 12 for directing heat downwardly toward a work space. After the heater 10 is first mounted on the ceiling 12, the housing 14 may be rotated in the clockwise direction, as indicated by the arrow in FIG. 8, to a first 45 degree position relative to the bracket arms, as shown in FIG. 8. As explained below, the housing may not thereafter be reversely rotated to the vertically-aligned position shown in FIG. 7. However, the housing 14 may then be further rotated in the clockwise direction, as indicated by the arrow in FIG. 9, to a second 45 degree position relative to the bracket arms 16 and 18, but may not be rotated beyond the second 45 degree position. Thus, for reason which will be discussed below, after initial rotation to the first 45 degree position shown in FIG. 8, rotation of the housing 14 relative to the bracket arms 16 and 18 is limited to 90 degrees.

With reference to FIGS. 10 through 12, the hub portion 90 of the bracket arm 18 is provided with an axially-extending slot or keyway 122 which is forwardly facing when the heater 10 is in the configuration shown in FIG. 1. The retaining ring 96 has a radially-inwardly extending key tab 124 formed thereon that is received in the keyway 122 when the retaining ring 96 is assembled onto the hub portion 90. Accordingly, the right side retaining ring 96 cannot rotate relative to the right side bracket arm 18. With reference to FIG. 13, the left side bracket arm 88 likewise has a keyway, designated 123, engaged by a key tab formed on the left side retaining ring 96 (FIG. 1) to prevent rotation therebetween.

In order to limit the rotation of the housing 14 relative to the bracket arms 16 and 18, and referring again to FIGS. 10 through 12, the right side retaining ring 96 has a radially-outwardly extending stop tab 126 formed thereon aligned with the radially-inwardly extending key tab 124. An arcuate abutment 128 projects inwardly from the inside surface of the right side end cap 32 and terminates at its ends in diametrically-opposed, upwardly-facing stop surfaces 128A and 128B. When the end cap 32 and the bracket arm 18 are assembled as shown in FIGS. 10 and 12, the stop surface 128B is so located that it will prevent counterclockwise rotation of the end cap 32, and accordingly, the entire housing 14, relative to the right side bracket arm 18.

As best shown in FIG. 12, a pair of arcuately-extending stop ramps 130 project inwardly from the inner surface of the right side end cap 32 circumferentially spaced by a few degrees from, respectively, the aforementioned stop surfaces 128A and 128B. The stop ramps 130 each taper inwardly to a maximum height at their uppermost ends and terminate in stop surfaces 130A and 130B, respectively, which are perpendicular to the inwardly-facing surface of the end cap 32. The left side end cap 30, being a mirror image of the right side end cap 32, likewise has the same arcuate abutment 128 and stop ramps 130.

When the heater housing 14 and the bracket arms 16 and 18 are relatively oriented in the positions shown in FIG. 7, the radially-outwardly extending tabs 126 are disposed between the abutment 128 and one of the ramps 130 at each side of the heater housing 13. If one attempts to rotate the housing 14 in a counterclockwise direction opposite the arrow shown in FIG. 8, the stop surface 128B engages the stop tab 126 to prevent such rotation. Thus, the heater may not be rotated from its initial packaging configuration to direct heat towards the ceiling 12. On the other hand, when one attempts to rotate the housing 14 in the direction of the arrow in FIG. 8 from its initial packaging configuration, the associated ramp 130 will cam the tab 126 inwardly toward the center of the housing 14 and thereby slide under the tab 126. Upon further rotation, the housing 14 will move to the position shown in FIG. 11 so that the tab 126 is no longer cammed inwardly by the ramp 130 and will snap over the upper end surface of the ramp 130. Thereafter, counterclockwise rotation of the housing 14 relative to the bracket arm 18 is prevented because the ramp surface 130B would strike and stop against the key tab 126. The housing 14 may, however, be rotated in the clockwise direction, as indicated by the arrows shown in FIGS. 8 and 9, until the stop surface 130A on the opposite ramp 130 engages the tab 126, which corresponds to the second 45 degree position shown in FIG. 9. The housing 14 may be rotated to various positions through the 90 degrees between the first and second 45 degree positions of FIGS. 8 and 9, wherein the tab 126 is between the stop surfaces 130A and 130B. It may be noted that the abutment 128 need not be continuous but could be formed in two parts provided that stop surfaces 128A and 128B are obtained.

To maintain the housing 14 at selected positions within the 90 degree permitted range of its motion, a plurality of elongate fingers 140 having outer concave surfaces project outwardly from both end caps 30 and 32 in a circular array concentric with the openings 92 and 94 and a plurality of detents 142 project inwardly in a circular array from within an arcuate wall 143 in the bottom margins of the bracket arms 16 and 18. This construction is shown best in relation to the left side bracket arm 16 in FIGS. 1 and 13. The fingers 140 are thin walled as well as elongate and somewhat resilient.

There are preferably twice as many detents 142 as there are resilient fingers 140 and, when the bracket arms 16 and 18 are attached to the end caps 30 and 32, respectively, and the housing 14 has been rotated to the position thereof shown in FIG. 8, the detents 142 engage the concave outer surfaces of the fingers 140 and in the spaces between the fingers 140 and thereby frictionally restrain the housing 14 against rotation relative to the support brackets 30. If the detents 142 are not so located relative to the fingers 140, the housing 14 may rotate until it reaches a position in which the detents 142 and the fingers 140 are so interfitted that the housing 14 will be held in a stable position.

Because the heater 10 is intended for mounting on the ceiling 12, it is beneficial to provide a means for operating the heater 10 from a position remote from the heater 10. With reference to FIG. 14, a pair of mutually spaced ball chains 150 are preferably connected to the control knob 118 so that one may pull on the ball chains 150 to rotate the control knob 118. Only one ball chain 150 is shown in FIG. 14, it being understood that the second ball chain and its connection to the control knob 118 are substantially identical to the ball chain shown and described. Alternatively, a pair of mutually spaced draw strings may be provided in lieu of the ball chains 150.

A ball 152 at the end of the ball chain 150 are received in a circular aperture 154 in the top of control knob 118, aperture 154 having a diameter larger than the balls 152 forming the ball chain 150. It should be understood, however, that more than one ball 152 may be received in the aperture 154. A second aperture 156 (FIG. 15) in the control knob 118 opens in a direction perpendicular to the first aperture 154. A slot 160 extending between the apertures 154 and 156 provides communication therebetween so that a wire 158 to which the balls are attached can be rotated through the slot 160 to a position extending through the second aperture 156. As is evident from FIG. 16, the second aperture 156 is smaller in diameter than the first aperture 154, and must be smaller in diameter than the balls 152 forming the ball chain 150.

When the ball chain 150 is rotated as described above, the ball 152 received in the first aperture 154 is located adjacent to and engages the inner surface 161 of the control knob 118 surrounding the second aperture 156. The ball chain 150 may be pulled to rotate the control 118 because the ball 152 held within the control knob 118 imparts the force on the end of the ball chain 150 to the control knob 118 which causes the control knob 118 to rotate. As shown in FIG. 14, the face of the control knob 118 may include indicia 162 that align with a marker (not shown) on the left side bracket arm 16 to indicate the position of the switch 98.

When the switch is rotated to the "off" position or the "high" position, it is desirable to inhibit further rotation of the control knob 118 to prevent damage to the switch 98. To this end, the wall 164 of the control knob 118 surrounding the second aperture 156 is thinner than the remainder of the control knob 118. As shown in FIG. 16, the thinner portion of the wall 164 appears as a depression 166 around the second aperture 156. When one of the ball chains 150 is pulled when the switch is in the "off" position or the other ball chain 150 is pulled when the switch is in the "high" position, the force on the ball chain 150 is not converted to rotary motion of the control knob 118, which would damage the switch 98. Rather, the ball 152 within the control knob cams against the depression 166 to enlarge the diameter of the second aperture 156 so that the ball 152 may be pulled through the second aperture 156.

To prevent damage to the switch 98, the wall 164 is sufficiently thin that force on the ball chain 150 cams open the second aperture 156 before the switch 98 is damaged. Furthermore, the ball chain 150 is sufficiently strong that the second aperture 156 will be cammed open before the ball chain 150 breaks. Thus, the ball chain 150 and control knob 118 provide a "break-away" connection. As discussed above, more than one ball 152 may be received in the control knob 118 so that a single hard pull on the ball chain 150 may not cause the ball chain 150 to become completely disconnected from the control knob 118.

Preferably, the heater 10 will be mounted on the ceiling 12 of a work space, but will be detachable from the ceiling 12. A support bracket 20 from which the housing 14 is suspended is mounted to the ceiling and has two mutually spaced pairs of key slots 168 formed therein that are connected in a well known manner to bolt or screw heads (not shown) projecting from the ceiling 12. The support bracket 20 has a pair of support arms 170 that extend downwardly from the ceiling 12 at opposite ends thereof. The support arms 170 are detachably connected to respective ones of the bracket arms 16 and 18 so that the housing 14 is suspended between the support arms 170.

Figure 3:
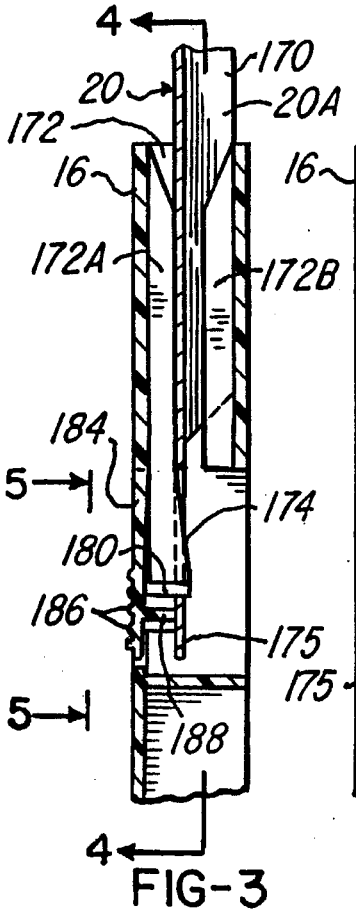
FIG. 3 is a fragmentary sectional view taken along line 3—3 of FIG. 2 showing, on a larger scale, the interconnection between the left side bracket arm and the support bracket of the heater of FIGS. 1 and 2.
Figure 4:
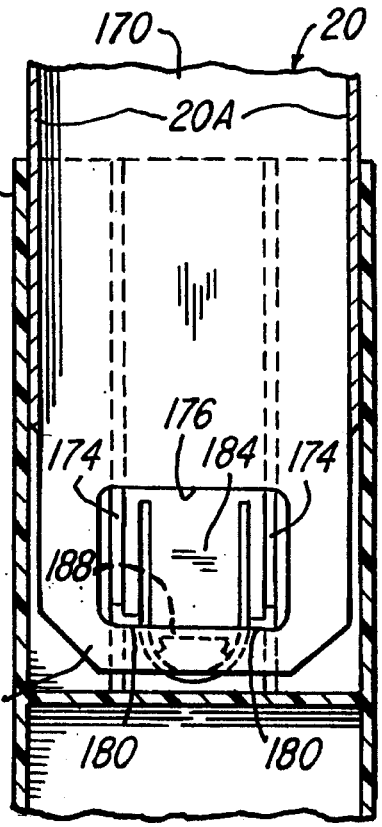
FIG. 4 is a fragmentary sectional view taken along line 4—4 of FIG. 3 further showing the interconnection between the left side bracket arm and the support bracket.

For purposes of this description, only the left side bracket arm 16 will be further described, but it should be understood that the bracket arm 18 is substantially a mirror image of bracket arm 16. With reference to FIGS. 1 and 3, the upper end of the bracket arm 16 is hollow to provide a socket, designated 172, for receiving the lower end of the left side bracket support arm 170. The socket 172 includes two pairs of ribs, namely outer ribs 172A and inner ribs 172B that extend vertically along the inner surfaces of the sidewalls of the bracket arm 16. As shown in FIG. 3, the lower ends of the outer ribs 172A (only one of which can be seen in FIG. 3) taper inwardly and downwardly to form ramp-like surfaces 174. The bottom ends of the outer ribs 172A, which are horizontally flanged as shown in FIG. 4, have downwardly-facing horizontal bottom surfaces 180.

When mounting the heater housing on the support bracket 20, the bracket arms 16 and 18 are raised by the person installing the same along with the heater housing 14 so that the support arms 170 are received within the sockets 172. As the bracket arms 16 and 18 are being raised, the ramp-like surfaces 174 engage and cam the lower ends of the support arms 170 inwardly until, when the bracket arms 16 and 18 are fully raised, the lower ends of the outer ribs 172A are located in openings or windows 176 in the lower ends of the support arms 170. At such time, the lower end, designated 175, of each support arm 170, which is below its associated window 176, snaps outwardly (i.e. the left side support arm 170 snaps to the left into the position illustrated in FIGS. 3 and 4) so that the lower ends 175 of the support arms 170 then engage the downwardly-facing surface 180 of the ribs 172A. The heater housing 14 may thereupon be released by the installer because it will by supported by the lower ends 175 of the support arms 170.

Figure 6:
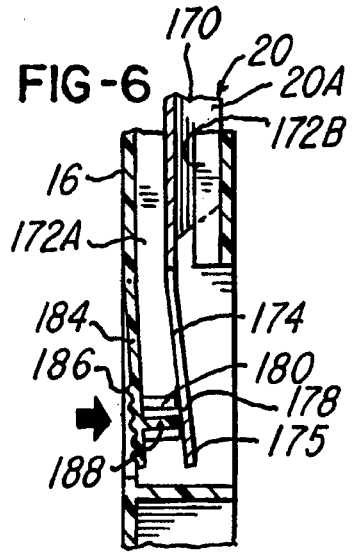
FIG. 6 is a fragmentary sectional view of parts of the left side bracket arm and the support bracket as shown in FIG. 3 but showing the push tab of FIG. 5 in engagement with the end of the support bracket to release the bracket arm from the support bracket.
Figure 5:
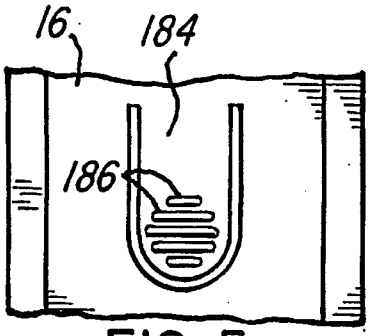
FIG. 5 is a fragmentary side elevational view of a portion of the left side bracket arm indicated by arrows 5—5 of FIG. 3.

So that the housing 14 may be removed from its ceiling-mounted position, it is preferred that the housing 14 be detachably connected to the support bracket 20. A push tab 184 is provided on and integral with the bracket arm 16 for detaching the heater 10 from the support bracket 20, as shown in FIG. 5. As further shown in FIG. 5, the push tab 184 has raised ridges 186 to facilitate actuation of the push tab 184 by a finger or the like. Push tab 184 has an inwardly-extending projection 188 formed thereon that is aligned with the lower end 175 of the support arm 170 when it is below the window 176. When the push tab 184 is pushed inwardly in the direction of the arrow shown in FIG. 6, a projection 188 on the push tab 184 engages the lower end 175 of the support arm 170 below the window 176 and moves the lower end 175 of the support arm 170 out of engagement with the bottom surfaces 180 of the ribs 172A, thereby allowing the bracket arm 16 to be moved downwardly relative to the support bracket 20. Of course, the bracket arm 18 is being lowered out of engagement with the right side support arm 170 at the same time. Both bracket arms 16 and 18 may then be moved further downwardly until the lower ends of the support arms 170 slide over the ramp-like surfaces 174 and thereafter out of the socket 172. It may be noted in FIG. 1 that the support bracket 20 has marginal flanges 20A for rigidity along its entire length except at the lower ends of its support 170, which must be sufficiently flexible that they can cam over the rib surfaces 174.

Figure 17:
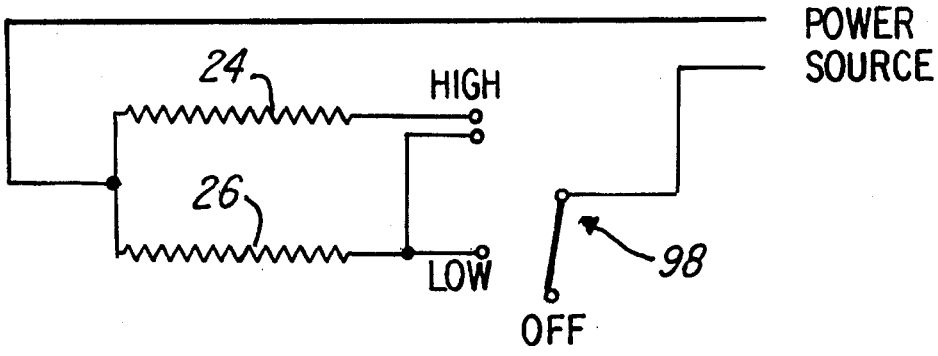
FIG. 17 is a circuit diagram showing a heater circuit used in the present invention.

With reference to FIG. 17, a preferred heater circuit is shown. However, the details of the electrical connections between the switch 98 and the heating elements 24 and 26 may be entirely conventional and form no part of the instant invention. As is evident from the circuit diagram, the three position switch 98 is connected in series between the heating elements 24 and 26 and a source of electrical power (not shown). When the switch is moved to a "low" position, only the heating element 26 is energized. When the switch is moved to the "high" position, heating elements 24 and 26 are both energized in parallel.

The heater circuit for the presently preferred embodiment of this invention may be a simple circuit as shown in FIG. 17 because no complex heat-limiting thermostats or other safety devices are required to meet recognized safety standards such as those required for approval by Underwriter's Laboratories, Inc. (UL). Safety circuits are not required because the heater of the preferred embodiment is intended to be mounted on the ceiling.

There are, however, aspects of the disclosed heater that contribute to the safety of the heater. For example, the support arms 170 of the support bracket 20 are sufficiently long that the housing 14 is not mounted close enough to the ceiling 12 to create a fire hazard. In addition, because rotation of the housing 14 relative to the bracket arms 16 and 18 is limited to positions between the first and second 45 degree positions shown in FIGS. 8 and 9, the housing 14 may not be pointed toward the ceiling 12, which could also create a potential fire hazard.

In addition, the end caps 30 and 32 are maintained cool to the touch so that they may be gripped to rotate the housing. The end caps are maintained cool, in part, by the baffle walls 34 and 36 which help maintain the shape of the outer wrapper 28 and insulate the end caps from unreflected heat energy from the heating elements 24 and 26 and the reflector assembly 22. The end caps 30 and 32 also have several slots or vents formed therein to assist in keeping the end caps 30 and 32 cool to the touch. In addition, heat is dissipated from the cavity between the baffle walls 34 and 36, the outer wrapper 28, and the reflector assembly 22 through slots or vents 190 formed in the outer wrapper 28. As briefly discussed above, the heater 10 may also include heat exhaust plates 60 and 62 on either side of the reflector assembly 22 between the end caps 30 and 32 and the reflector assembly 22. The exhaust plates also include slots or vents 192 that also allow heat to escape from the cavity between the baffle walls 34 and 36, the outer wrapper 28, and the reflector assembly 22.

As is well known, heat energy tends to rise upwardly. Because the heater 10 is designed for mounting on a ceiling 12 so that heat from the heater 10 is directed downwardly towards a work space, heat energy from the heater 10 will tend to rise upwardly and flow around the margins 42 and 44 of the reflector assembly 22 and the margins 46 and 48 of the outer wrapper 28 that extend between the exhaust plates 60 and 62. As the heat energy rises and flows around the margins 42, 44, 46 and 48, a heat build-up occurs on the surfaces around the margins 42, 44, 46 and 48.

Figure 18:
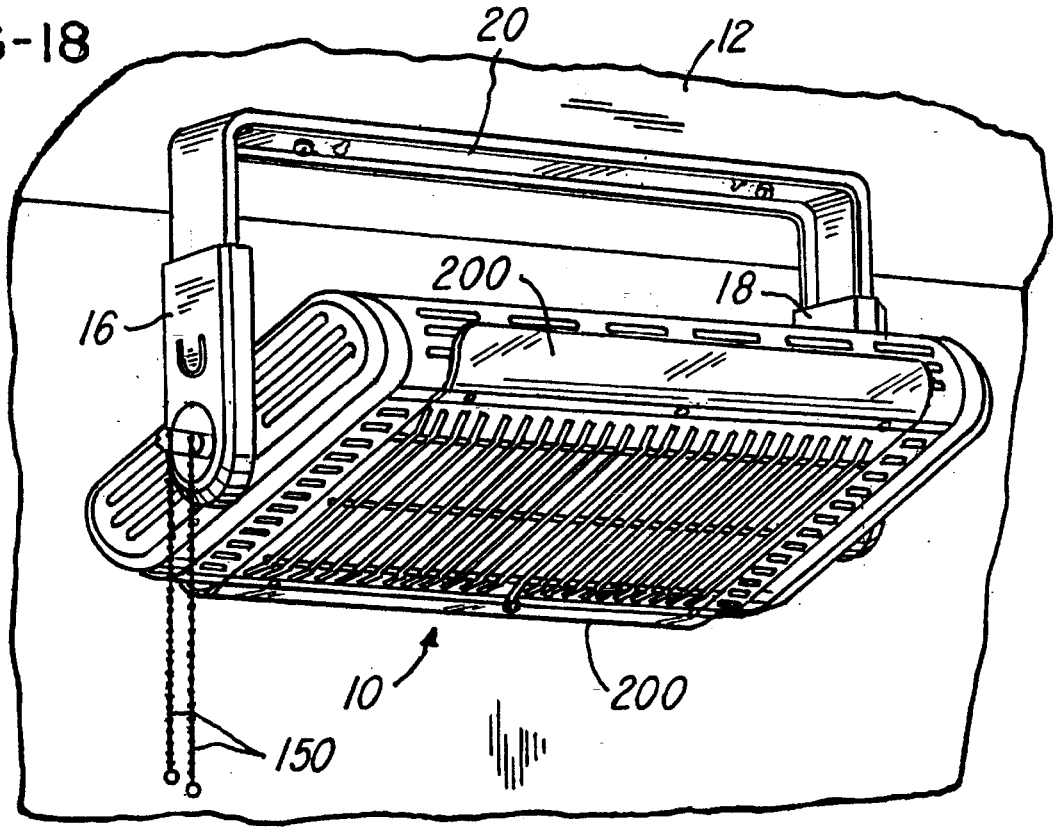
FIG. 18 is a perspective view similar to FIG. 2, but showing a second embodiment of heater in accordance with this invention.

With reference to FIG. 18, the heater 10 may be provided with a pair of heat shields 200 that extend along opposite margins 42 and 44 of the reflector assembly 22 to protect against this heat build-up. The heat shields 200 can be metal sheets that project away from the reflector assembly 22 and prevent the rising heat energy from flowing directly across the margins 42 and 44 of the reflector assembly 22 by impeding the flow of heat energy and directing the heat energy away from the housing 14. Because the heat shields extend away from the reflector assembly 22 as shown in FIG. 18, indicia on the shield indicating that the surface is "HOT" should be visible from below when the heater 10 is mounted on the ceiling 12.

It is preferred that a heat shield 200 be provided along both margins 42 and 44 of the reflector assembly 22 that extend between the exhaust plates 60 and 62, as shown in FIG. 18, because heat energy will flow across both margins 42 and 44 of the reflector assembly 22. However, it is apparent that the surfaces surrounding the "upper" margin, i.e. the margin closer to the ceiling 12, will be more susceptible to a heat build-up than the surfaces surrounding the "lower" margin because the upper surfaces will be exposed to more rising heat energy. Because the heater 10 is pivotable, either margin can be the upper margin in the presently preferred embodiment. Therefore, it is preferred to have a heat shield 200 along both margins 42 and 44 to protect whichever margin may be the upper margin at any given time.

The heat shields 200 may be attached to the reflector assembly 22 by the screws 39 that are used to attach the reflector assembly 22 to the outer wrapper 28. Alternatively, the heat shields 200 may be integral with the reflector assembly 22. In the latter configuration, the heat shields 200 may simply be extension of the reflector panel 50.

Many features of this invention are equally applicable to heaters that are intended be mounted on a wall for heating a work space. If the heater 10 is intended for wall mounting, however, the heater will likely be required to meet stricter safety conditions and pass tests such as a drape test in which cloth or other material is draped over the front of the heater. Safety devices and a circuit showing their connection to a portable heater using heating elements and a reflector assembly similar to those used in the heater of this invention are shown in the aforementioned Mills '509 patent. Heat dissipating devices such as a fan, as shown in the Mills '509 patent, may also be used if the heater is intended for wall mounting.

Although the presently preferred embodiments of this invention have been described, it will be understood that within the purview of the invention various changes may be made within the scope of the following claims.

Having thus described my invention, I claim:

1. A radiant electric heater, comprising:

a housing;

a reflector assembly mounted in said housing;

a heating element disposed in said reflector assembly and extending between opposite ends thereof;

a first bracket arm rotatably connected to one end of said housing;

a second bracket arm rotatably connected to the opposite end of said housing, said bracket arms defining an axis of rotation of said housing;

an inverted U-shaped support bracket mounted to a planar surface and having first and second mutually spaced support arms, said first bracket arm detachably connected to said first support arm and said second bracket arm detachably connected to said second support arm; and a control switch mounted on one of said bracket arms and electrically connected to said heating element, said control switch having a control shaft extending therefrom substantially centered on said axis of rotation.

2. The heater of claim 1 wherein said planar surface is a wall.

3. The heater of claim 1 wherein said planar surface is a ceiling.

4. The heater of claim 1 wherein each of said bracket arms includes a raised portion having a stop surface that engages the end the support arm connected thereto.

5. The heater of claim 4 wherein each of said bracket arms further includes a push tab movable into engagement with the end of the support arm detachably connected thereto to move the end out of engagement with said stop surface.

6. The heater of claim 1 wherein said housing is rotatable relative to said bracket arms throughout an angle of not more than substantially 90 degrees.

7. The heater of claim 1 wherein said housing has concave fingers extending therefrom and said bracket arms have detents that cooperate with said fingers to hold said housing in any one of a plurality of angular positions relative to said bracket arms.

8. The heater of claim 1 further comprising a control knob secured to said shaft and also substantially centered on said axis of rotation.

9. The heater of claim 8 further comprising a ball chain extending from said control knob.

10. The heater of claim 9 wherein said control switch comprises a rotary switch and wherein said ball chain is operable to rotate said control knob.

11. The heater of claim 10 wherein said control knob has an inner surface and an aperture having a diameter smaller than the diameter of said ball chain, and wherein a portion of said ball chain extends through said aperture and has a ball engaging the inner surface of said control knob adjacent said aperture.

12. The heater of claim 11 wherein said control switch has a plurality of positions and wherein force exerted on said ball chain in a direction away from said control knob when said control switch is in one of said positions causes said ball of said ball chain engaging the inner surface of said control knob to expand said aperture and move therethrough.

13. The heater of claim 1 wherein said housing comprises an outer wrapper, a first end cap attached to one end of said outer wrapper, and a second end cap attached to the opposite end of said outer wrapper.

14. The heater of claim 13 further comprising a pair of baffle walls connected to said outer wrapper at opposite ends thereof and adjacent respective ones of said end caps, said baffle walls insulating said end caps from non-reflected heat energy from said heating element and said reflector assembly so that said end caps remain cool to the touch.

15. The heater of claim 14 wherein said housing further comprises a first slotted heat exhaust plates between said reflector assembly and said first end cap and a second slotted heat exhaust plates between said reflector assembly and said second end cap.

16. The heater of claim 13 wherein said first bracket arm is rotatably connected to said first end cap and said second bracket arm is rotatably connected to said second end cap.

17. The heater of claim 16 wherein each of said bracket arms has a cylindrical, hub portion projecting therefrom, wherein each end cap has a circular opening formed therein that receives the hub portion of the bracket arm to which said each of said bracket arms is attached, and further comprising a pair retaining rings frictionally engaged with the cylindrical, hub portion of respective ones of said bracket arms to secure said bracket arms to said housing.

18. The heater of claim 17 wherein each of said retaining rings has a radially-inwardly extending tab and wherein the cylindrical, hub portion of each of said bracket arms has a axially-extending keyway formed therein that receives the radially-inwardly extending tab of the retaining ring frictionally engaged therewith to fixedly position said retaining ring relative to said bracket arm.

19. The heater of claim 17 wherein each of said end caps has an inner surface and a pair raised stop surfaces formed on said inner surface radially-spaced from the opening therein, and wherein each of said retaining rings further has a radially-outwardly extending tab located between the stop surfaces on its associated end cap, said stop surfaces engaging said tab to limit rotation of said housing relative to said bracket arms.

20. The heater of claim 19 wherein said stop surfaces are angularly spaced apart by not more than 90 degrees so that rotation of said housing relative to said bracket arms is limited to not more than 90 degrees.

21. A radiant electric heater, comprising:

a housing having first and second ends;

a reflector assembly mounted in said housing;

a heating element disposed in said reflector assembly and extending between opposite ends thereof;

a first bracket arm rotatably connected to said first end of said housing and having a cylindrical, hub portion projecting therefrom;

a second bracket arm rotatably connected to said second end of said housing and having a cylindrical, hub portion projecting therefrom;

an inverted U-shaped support bracket mounted to a planar surface and having first and second mutually spaced support arms, said first bracket arm detachably connected to said first support arm and said second bracket arm detachably connected to said second support arm;

wherein said first end of said housing has a circular opening formed therein that receives the hub portion of said first bracket arm and said second end of said housing has a circular opening formed therein that receives the hub portion of said second bracket arm; and a pair retaining rings frictionally engaged with the cylindrical, hub portion of respective ones of said bracket arms to secure said bracket arms to said housing.

22. The heater of claim 21 wherein each of said retaining rings has a radially-inwardly extending tab and wherein the cylindrical, hub portion of each of said bracket arms has a axially-extending keyway formed therein that receives the radially-inwardly extending tab of the retaining ring frictionally engaged therewith to fixedly position said retaining ring relative to said bracket arm.

23. The heater of claim 22 wherein each of said first and second ends of said housing has an inner surface and a pair of raised stop surfaces formed on said inner surface radially-spaced from the opening therein, and wherein each of said retaining rings further has a radially-outwardly extending tab located between the stop surfaces on its associated end of said housing, said stop surfaces engaging said tab to limit rotation of said housing relative to said bracket arms.

24. The heater of claim 23 wherein said stop surfaces are angularly spaced apart by not more than 90 degrees so that rotation of said housing relative to said bracket arms is limited to not more than 90 degrees.

25. A radiant electric heater, comprising:

a housing;

a reflector assembly mounted in said housing and having a margin adjacent said housing;

a heating element disposed in said reflector assembly and extending between said opposite ends thereof;

a first bracket arm rotatably attached to one end of said housing;

a second bracket arm rotatably attached to the opposite end of said housing;

an inverted U-shaped support bracket mounted to a planar surface and having first and second mutually spaced support arms, said first bracket arm detachably connected to said first support arm and said second bracket arm detachably connected to said second support arm; and a heat shield mounted to and extending along said margin and adapted to impede the upward flow of heat energy from said heating element and to direct the heat energy away from surfaces of said housing adjacent said margin.

26. The heater of claim 25 wherein said heat shield comprises a metal sheet that extends along said margin substantially the entire width of said reflector assembly and projects away from said reflector assembly.

27. The heater of claim 26 further comprising a second heat shield substantially identical to said first-mentioned heat shield and mounted to and extending along a second margin of said reflector assembly opposite said first-mentioned margin.

* * * * *